United States Patent [19]

Harris et al.

[11] Patent Number: 4,762,242

[45] Date of Patent: Aug. 9, 1988

[54] RETRACTABLE COVER FOR AN OPENING HAVING LIMITED STACKING SPACE

[76] Inventors: Jesse W. Harris, 3006 Mayfair, San Antonio, Tex. 78217; James K. Kuhns, 3106 Colony Dr., San Antonio, Tex. 78230

[21] Appl. No.: 109,496

[22] Filed: Oct. 16, 1987

[51] Int. Cl.[4] ..... B65D 43/20

[52] U.S. Cl. ..... 220/18; 220/345

[58] Field of Search ..... 220/1 T, 18, 345, 346; 312/298, 312

[56] References Cited

U.S. PATENT DOCUMENTS

| | | | |
|---|---|---|---|
| 2,223,023 | 11/1940 | Weilemann | 220/345 |
| 3,295,907 | 1/1967 | Galvin | 220/345 |
| 4,653,662 | 3/1987 | Wise et al. | 220/345 |

*Primary Examiner*—George T. Hall

*Attorney, Agent, or Firm*—Cox & Smith, Inc.

[57] ABSTRACT

A retractable cover for closing an opening in a substantially flat surface. The cover has particular application for closing the oil change pit in the floor of a vehicle service facility. The cover comprises a plurality of stacked flat members, each of the flat members being provided with a clasper for engaging the flat member which is stacked therebelow as well as a wheel for engaging a track for guiding the extension of flat members from a first, retracted position in which the flat members are stacked directly above each other to allow access to the opening to a second, extended position in which the flat members are stacked in staircase fashion to cover the opening. Each of the flat members is provided with a stop for engaging the flat member stacked therebelow to retain the flat members in engagement with each other when extended to the second position.

12 Claims, 2 Drawing Sheets

RETRACTABLE COVER FOR AN OPENING HAVING LIMITED STACKING SPACE

BACKGROUND OF THE INVENTION

The present invention relates to a retractable cover for covering an opening in a substantially flat surface. In more detail, the present invention relates to a retractable cover for closing an opening such as the opening to an oil change pit in the floor of an automobile or other vehicle repair shop in which the space for the stack of the cover when retracted is limited.

Many vehicle repair shops are provided with openings, or pits, in the floor to facilitate access to the underside of the vehicle. As a result of the recent growth in the number of self-service gasoline stations and the large number of consumers who are pumping their own gas, there has been a large increase in the number of businesses which market services such as oil changes and vehicle lubrication. Such business may have several service bays, each provided with a pit in the floor. Those pits are two to four feet wide and may be twenty feet or longer in length. The vehicle is driven into the service bay straddling the pit, which is deep enough to allow a mechanic to stand erect underneath the automobile. Such pits are also found in motor and service pool facilitites and even between the rails of railroad tracks running through diesel locomotive service facilities.

No matter what the location, such pits are a substantial safety hazard. Such large openings in a substantially flat floor are a safety hazard which have, unfortunately, been the cause of many falls and injuries. These pits which are surrounded by a raised, metal border, such as those which are commonly found in oil change service businesses, are particularly dangerous because that raised metal border projects upwardly from the floor from one to three inches and represents an obstacle over which persons can trip, causing them to fall into the pit. Such pits are provided with that barrier to serve as a guide and bumper rail to warn drivers of the closeness of their vehicle to the edge of the pit as the vehicle is positioned over the pit for servicing.

The safety hazard presented by such pits, therefore, creates a need for a cover for such pits which can be retracted to allow the mechanic to either enter the pit or service a vehicle, and which can be extended to cover the pit once the service has been accomplished to remove or reduce the hazard presented by the pit. It is, therefore, an object of the present invention to provide such a cover, thereby preventing injuries to the mechanics and customers of such businesses.

Providing such a cover is made difficult, however, by the limited vertical space which is available in such installations. In actual practice, as little as three inches of vertical space is available between the bottom of the lowest vehicle which is serviced from such pits and the top of the waste oil collection pan with which the pit is supplied. It is desirable to raise that pan as high as possible to decrease the spillage of oil from the vehicle when the drain plug is removed, hence the vertical space limitation. That vertical space limitation, of course, inconsistent with the object of providing a safety cover for such pits which is strong enough to withstand the force of, for instance, a 250 pound service technician who falls on the cover because, as a general rule, each panel of the cover needs to be thick enough to provide the necessary rigidity. It is, therefore, also an object of the present invention to provide a retractable cover for an opening which is of particular use in installations in which the vertical space which is available is limited yet the cover must be rigid enough to withstand the impact of substantial force anywhere along the length of the cover.

It is another object of the present invention to provide a retractable cover for an opening in a substantially flat surface which is adaptable for use in a number of applications, for instance, as the trash racks of a hydropower installation or the entrance to a sewer grating or ventilation shaft. Such installations require the ability to retract or remove the cover at relatively frequent intervals for service and/or cleaning. A light weight, retractable cover which can easily be removed from such openings at frequent intervals greatly facilitates such operations.

Other uses, objects, and advantages of the present invention will be clear to those skilled in the art from the following description of the presently preferred embodiments of the present invention.

SUMMARY OF THE INVENTION

These objects and advantages are met by providing a retractable cover for an opening with limited stacking space in a substantially flat surface comprising a plurality of stacked, flat members, each of the members having means mounted to one edge thereof for slidably engaging the float member which is stacked immediately therebelow. Means is mounted to one edge of each of the flat members for slidably engaging a track for guiding the extension of the stack of flat members from a first, retracted position in which the flat members are stacked directly above each other for access through the opening to a second, extended position in which the flat members are stacked in staircase fashion for covering the opening. Each of the flat members is also provided with stop means for engaging the flat member therebelow to retain the flat members in engagement with each other when they are extended to the second position.

The object of providing a rigid, retractable cover for use in installations in which the available vertical space, or "stacking space", is limited is met by providing each flat member with two crossmembers, one at the front of the flat member and one at the rear. The front crossmember of each flat member is mounted to the top of each flat member and the rear crossmember is mounted to the bottom so that when the flat members are in the first, retracted position, the crossmembers are closely approximated with each other in side-by-side fashion so as not to add to the height of the stack of flat members. Further, when the flat members are extended to the second position for covering the opening, the front crossmember of each flat member is positioned close to being above the rear crossmember mounted to the bottom of the flat member therebelow, thereby adding to the rigidity of the cover even when the cover is used to cover an opening which may be twenty or more feet long. In this manner, a rigid cover is provided which can be comprised of as many as ten flat members, each between two and four feet wide and several feet long, which retract into a vertical stack which is approximately three inches high.

DETAILED DESCRIPTION OF THE PREFERRED EMBODIMENTS

Throughout the following detailed description of the presently preferred embodiments of the invention, reference will be made to an opening in a substantially flat surface. It will be understood by those skilled in the art who have the benefit of this disclosure that the opening could be any opening in any substantially flat surface. The opening could be, for instance, an opening of a pit in the floor of a business for changing the oil in an automobile or the opening of a ventilating shaft for an underground subway system. Further, the substantially flat surface could, like the flat members which comprise the retractable cover, be curved such that the apparatus of the present invention is used to cover an opening in a curved surface. The curve of that surface need only be gradual enough with respect to the dimensions of the size of the opening that the surface, for all practical purposes, and as a result of the curve in the flat members, can be considered substantially flat. It will also be understood that the opening need not be an opening in a horizontal surface. The water inlet of a dam for the generation of hydroelectric power is often set at an angle with respect to the horizontal, and the apparatus of the present invention can be used to advantage to cover such openings to strain trash, branches, and other flotsam out of the water which could otherwise damage the hydroelectric turbines. The retractable cover of the present invention can also be constructed of light weight aluminum or plastic and used to cover the opening of, for instance, a ventilating or air conditioning inlet or outlet in a substantially vertical wall or as a portable wall.

Figure 1:
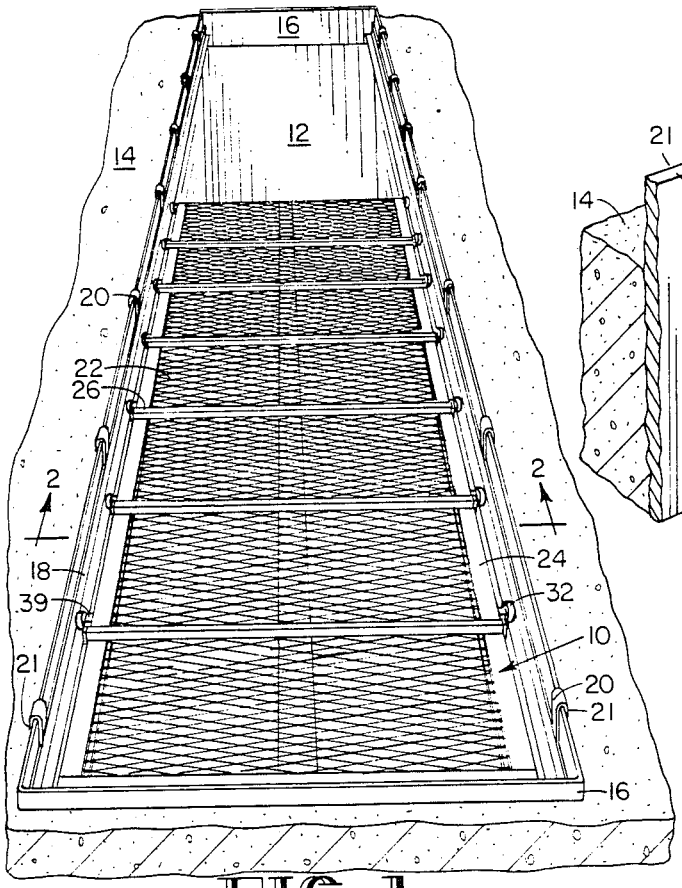
FIG. 1 is a perspective view of a presently preferred embodiment of the retractable cover of the invention covering an opening in the floor, such as an oil change pit, looking at the cover from the end thereof.

Referring now to the figures, the retractable cover of the present invention is shown in perspective view at reference numeral 10 in FIG. 1. The retractable cover 10 covers a portion of the oil change pit 12 in the floor 14 of an automobile service business (the remainder of pit 12 is covered by a similar cover 10 (not shown)). The walls of pit 12 are lined with a metal border 16 which projects above the surface of the floor 14. Although many such pits 12 are provided with a metal border 16, it will be understood that the retractable cover 10 of the present invention can be adapted for use in connection with openings in flat surfaces which are not so provided. The metal border 16 which, as described above, is used to advantage as a point of attachment for cover 10, is also shown clearly in FIG. 5. Each side of pit 12 is provided with a track 18 having a plurality of integral hangers 20, the hooks 21 of which extend over the top of the border 16 to retain the track 18 in place against the wall of pit 12. As will be explained, the cover 10 is provided with a plurality of wheels 32 which rest upon track 18 to support the cover 10 over pit 12. The track 18 can also be constructed from a U-shaped channel member (not shown) rather than the angle iron shown at reference numeral 18 with the wheels 32 resting and retained within the channel for use of the retractable cover 10 to cover the opening in a surface which is not substantially horizontal. Track 18 can be bolted, welded or otherwise fixed in place relative to the wall of the opening.

The cover 10 is comprised of plurality of stacked flat members, each of the flat members comprising an expanded metal grate 22, side bars 24, front 26 and rear 28 crossmembers, brace 29, and spacers 31, all of which are welded, screwed, or fastened together to form an integral panel. As more clearly shown in FIG. 3, the front crossmember 26 is mounted to the top of each grate 22 and rear crossmember 28 is mounted to the bottom. Although shown as square in the figures, it will be understood that front and rear crossmembers 26 and 28 could be cylindrical, triangular or any other crosssectional shape which will impart the necessary rigidity to the crossmember. Side bars 24, brace 29 and spacers 31 are also provided because the expanded metal grate 22 used as the body of each flat member in the presently preferred embodiment is not itself sufficiently rigid to support the weight of a person and to provide the necessary rigidity to the cover 10. Grate 22 is, therefore, welded to side bars 24 and spacers 31 at the edges thereof and brace 29 is welded down the middle of grate 22 to provide further rigidity. Each of the flat members can also be made of plexiglass, plastic, or aluminum panels such that one or more of the side bars 24, brace 29 and/or spacers 31 may not be necessary to provide the necessary rigidity, or where the cover 10 is used for purposes other than to cover an oil change pit 12, where rigidity is not a requirement of the particular application. In some instances, rigidity may even be undesirable as, for instance, when the cover 10 is used to cover the opening in a curved surface. Depending upon the material comprising each of the flat members, front and rear crossmembers 26 and 28, respectively, may be cast or formed from the same material as the rest of the flat member and, therefore, integral therewith.

Figure 3:
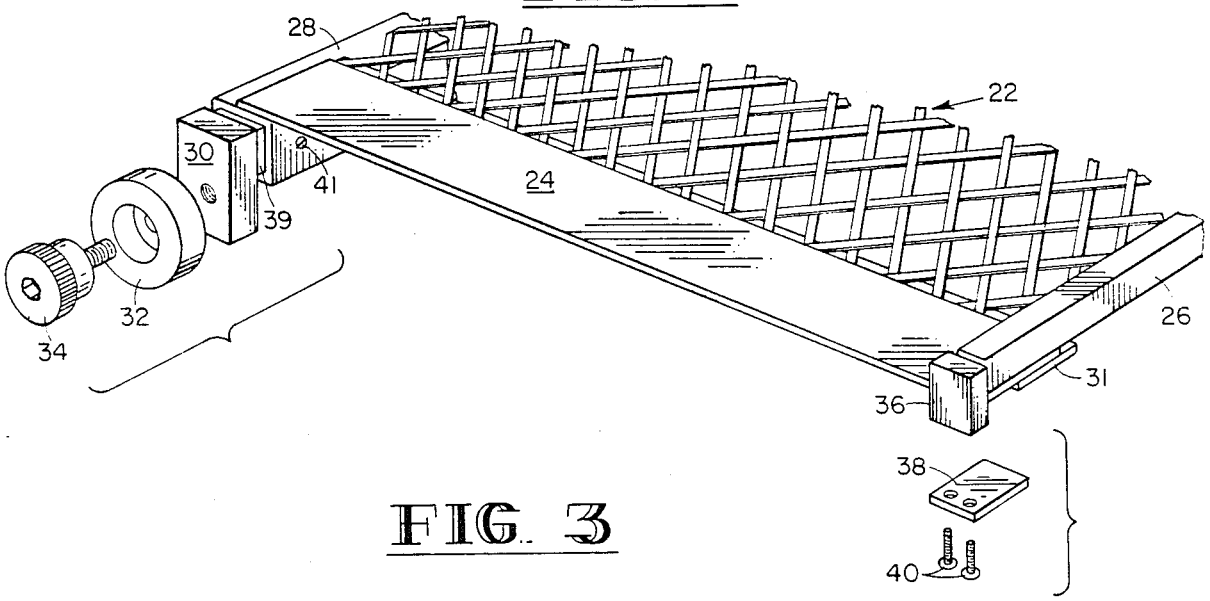
FIG. 3 is an exploded view of a portion of the apparatus of FIG. 1.
Figure 4A:
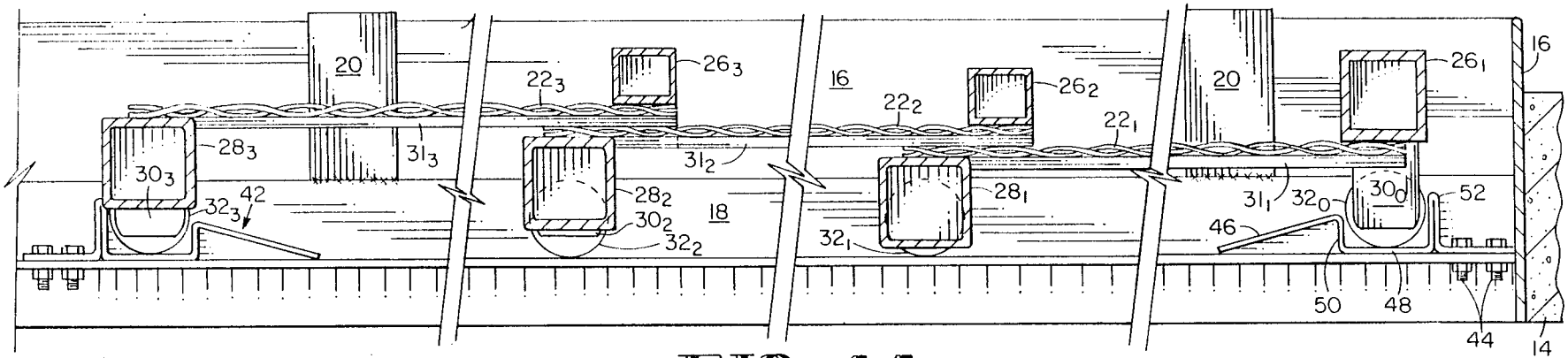
FIGS. 4A and 4B are longitudinal sections through an alternative embodiment of the apparatus of the present invention showing the apparatus in the extended (FIG. 4A) and retracted (FIG. 4B) positions.
Figure 4B:
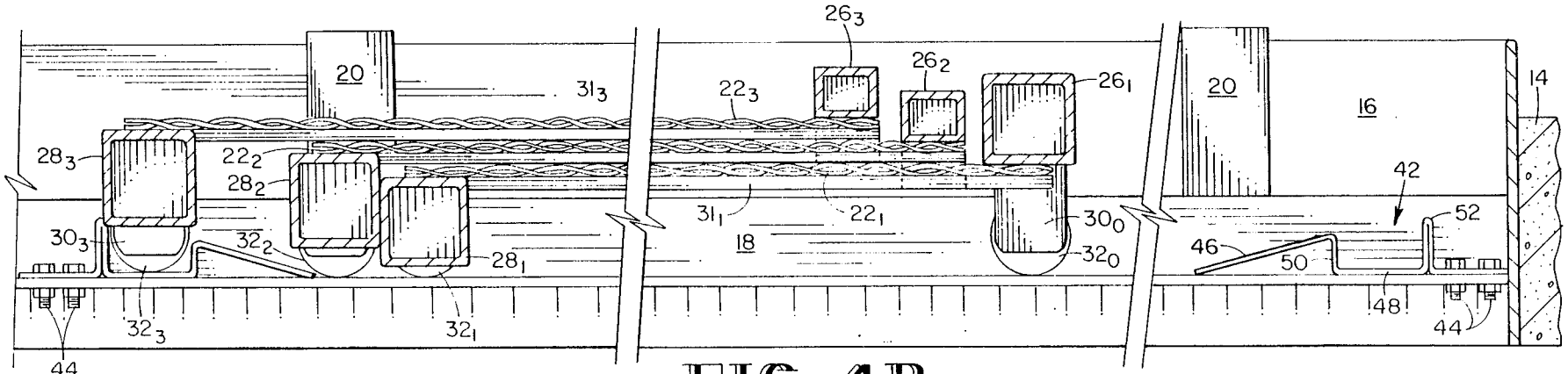

The flat members, or panels, are stacked one on top of the other as best shown in the alternative embodiment shown in FIG. 4B in a first, retracted position in which the flat members are stacked directly above each other to allow access to the opening such as the pit 12 in floor 14. The flat members, or panels, are retained in that stack by means mounted to one edge of each panel for slidably engaging the panel stacked therebelow in the form of an integral clasper 38. Claspers 38 are mounted by screws 40 (see FIG. 3) to an end cap 36 mounted to the ends of front crossmember 26 which is integral with grate 22. The bottom surface of the sidebar 24 of each flat member is engaged by the top surface of clasper 38. The inside edge of end cap 36 also helps retain each flat member in engagement with the flat member therebelow by engaging the edge of the side bars 24 of that flat member in the event of lateral movement of the flat members with respect to each other.

As shown in the alternative embodiment shown in Fig. 4B, when in the first, retracted position, the rear crossmembers $28_1$ and $28_2$ are closely approximated with each other in side-by-side fashion, thereby making a minimal contribution to the height of the stack of flat members. Also as shown in that figure, the front crossmembers $26_1$, $26_2$, and $26_3$, are closely approximated in side-by-side fashion to minimize the height of the stack.

When extended to the second position covering the opening in floor 14, as shown in FIG. 4A, the front crossmember $26_2$ of the second flat member is positioned close to being above the rear crossmember $28_1$ mounted to the bottom of the flat member therebelow i.e., the flat member comprised of grate $22_1$. Likewise, front crossmember $26_3$ is close to being positioned above rear crossmember $28_2$. Positioning the front crossmember 26 of each flat member closely over the rear crossmember 28 of the flat member therebelow in that fashion substantially increases the rigidity of the flat members when in the second, extended position.

Each of the rear crossmembers 28 is provided with a leg 30 mounted to the ends thereof to which a wheel 32 is mounted over bearing 34. The wheels 32 provide a means for slidably engaging the above-described track 18 mounted to the walls of pit 12 for guiding the extension of the stack of flat members from the first, retracted position in which the flat members are stacked directly above each other for access to the pit 12 to a second, extended position in which the flat members are stacked in staircase fashion for covering the opening as shown in FIG. 1. Leg 30 is mounted to the ends of rear crossmember 28 on an extension arm 39 (see FIG. 3) which is telescopically received within and can be extended from or retracted into rear crossmember 28 as necessary to insure that the wheels 32 on both edges of each flat member engage track 18. That adjustability allows the flat members of cover 10 to be manufactured in certain discrete widths, the final adjustment to fit the width of the opening to be covered being made upon installation. Set screws 41 are provided in each crossmember 28 for selectively retaining extension arm 39 in extended position at the proper width.

As the flat members, or panels, of the retractable cover 10 are extended from the first, retracted position to the second, extended position shown in FIG. 1, each of the panels rides on track 18 and the end caps 36, with the claspers 38 of each flat member mounted thereto, retain each flat member in sliding engagement with the flat member in the stack immediately therebelow. Each flat member is also provided with stop means for engaging the flat member therebelow to retain the flat members in engagement with each other when extended to the second position shown in FIG. 1. That stop means takes the form of the engagement of the edge of clasper 38 by the edge of rear crossmember 28 once each flat member has been extended from underneath the flat member immediately thereabove (see FIG. 4A). Because the flat members are, when extended, still in engagement with each other, and are, therefore, still stacked, the spatial relationship of the extended flat members is described herein as being stacked in staircase fashion.

Figure 2:
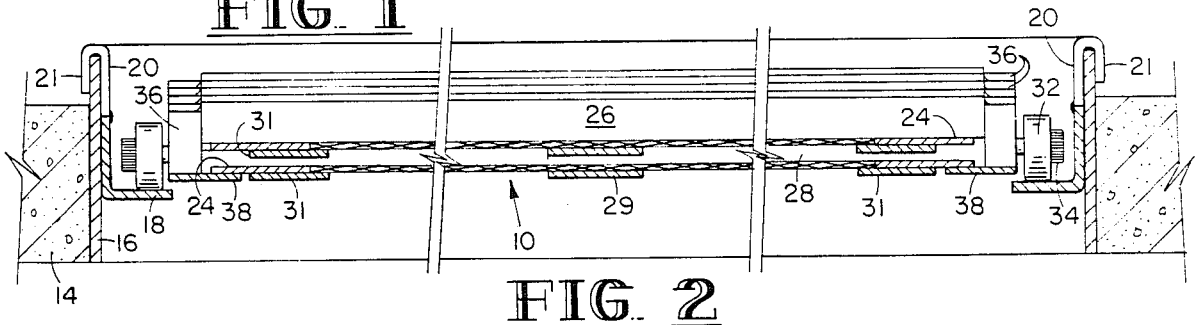
FIG. 2 is a cross-section of the retractable cover of FIG. 1 taken along the lines 2—2 in FIG. 1.

By way of further explanation, an alternative embodiment of the present invention is shown in FIG. 4A and 4B. However, because the alternative embodiment shown in FIGS. 4A and 4B is constructed in the same manner as the embodiment shown in FIGS. 1–3, the same reference numerals are used to identify the various structural parts thereof. The difference between the embodiment shown in FIGS. 1–3 and the embodiment shown in FIGS. 4A and 4B is that the embodiment shown in FIGS. 1–3 is comprised of seven flat members while the embodiment shown in FIGS. 4A and 4B is comprised of only three flat members.

Reference to FIG. 4A illustrates the staircase fashion in which the flat members are stacked when the retractable cover 10 is extended to the second position covering the opening in the flat surface 14, each of the component parts of the flat members being labelled with a subscript corresponding to the first, second, or third flat member stacked in staircase fashion. It can be seen that the first flat member is provided with two wheels, one mounted on the leg $30_1$ (not visible in FIGS. 4A and 4B), and the other mounted on leg $30_0$ mounted to the ends of front crossmember $26_1$. It can be seen that the legs $30_1$, $30_2$, and $30_3$ are of a different length depending upon the distance between the track 18 and the crossmembers $28_1$, $28_2$ and $28_3$, respectively, the difference being the result of the stacking of the flat members.

Figure 5:
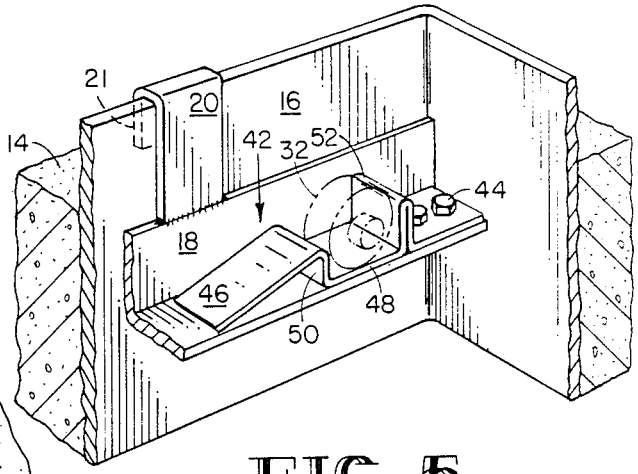
FIG. 5 shows a cutaway, perspective view of the corner of the wall of the pit in which the apparatus of FIG. 1 is mounted.

The alternative embodiment shown in FIGS. 4A and 4B is provided with means for retaining the flat members in the extended position in the form of stops 42 mounted to track 18 by screws 44. As shown in FIG. 4A, stops 42 are mounted at the end of pit 12 or anywhere along the length of the track 18. Stop 42 is comprised of a first ramp portion 46 and a second retainer portion 48, the retainer portion 48 being formed by the vertical portion 50 of ramp 46 and a hairpin bend 52 in the metal strip forming stop 42. The ramp 46 allows the caster $32_0$ to be moved into the retainer portion 48 of stop 42, but the vertical portion 50 of ramp 46 and the hairpin bend 52 prevent or resist the movement of caster $32_0$ out of the retainer 48 thereby retaining one end of cover 10 at the end of pit 12 as shown in FIG. 5. It will be understood that the stops 42 could be formed of two ramps 46, having a retainer 48 therebetween, to provide for the extension of the cover 10 to an intermediate position along the length of pit 12.

Although the invention has been described in terms of the above-characterized presently preferred embodiment, it will be understood by those skilled in the art who have the benefit of this disclosure that a number of alterations and changes can be made in the preferred embodiment without departing from the spirit and scope of the present invention as set out in the following claims.

What is claimed is:

1. A retractable cover for an opening in a substantially flat surface comprising:

a plurality of stacked flat members;

means mounted to one edge of each of said flat members for slidably engaging the flat member stacked therebelow;

means mounted to one edge of each of said flat members for engaging a track for guiding the extension of the stack of said flat members from a first, retracted position in which said flat members are stacked directly above each other for access to an opening in a substantially flat surface to a second, extended position in which said flat members are stacked in staircase fashion for covering the opening; and stop means on each of said flat members for engaging the flat member therebelow to retain said flat members in engagement with each other when extended to said second position.

2. The retractable cover of claim 1 wherein said flat member engaging means comprises a clasper mounted to each edge of said flat member, the upper surface of said clasper slidably engaging the lower surface of the flat member therebelow.

3. The retractable cover of claim 1 wherein said track engaging means comprises a wheel mounted to each edge of said flat member.

4. The retractable cover of claim 3 wherein said wheel is mounted on an extension arm, said extension arm being telescopically received within the edge of said flat member, for insuring the engagement of said track by said wheel.

5. The retractable cover of claim 4 wherein said extension arm is provided with means for selectively retaining said extension arm in an extended position.

6. The retractable cover of claim 1 wherein said stop means comprises a crossmember mounted to each of said flat members for engaging said flat member engaging means when said flat members are extended to said second position.

7. The retractable cover of claim 6 wherein the crossmember is mounted to the rear of said flat member and the rear crossmembers of each of said flat members are closely approximated in side-by-side fashion when said flat members are in said first retracted position.

8. The retractable cover of claim 7 additionally comprising a crossmember mounted ot the front of each of said flat members, the rear crossmembers being mounted to the bottom of each of said flat members and the front crossmembers mounted to the top of said flat members, the front crossmembers being closely approximated in side-by-side fashion when said flat members are in said first, retracted position.

9. The retractable cover of claim 8 wherein the front crossmember of each of said flat members is positioned close to being above the rear crossmember of the flat member therebelow when said cover is extended to said second position for covering the opening.

10. A retractable safety cover for an oil change pit comprising:

a plurality of stacked panels;

a crossmember mounted to the edge of each of said panels and having a wheel mounted to each and thereof;

a track mounted to the wall of an oil change pit on which the wheels of said panels rest;

a clasper mounted on the edge of each of said panels for slidably engaging the panel stacked therebelow and for engaging said crossmember to retain said panels in engagement with each other when said panels are extended from a first position in which said panels are stacked directly on top of each other to a second position in which said panels are stacked on top of each other in staircase fashion.

11. The retractable safety cover of claim 10 wherein said track is provided with stop means for retaining the wheel of one of said panels to prevent movement of said panel with respect to said track.

12. The retractable safety cover of claim 11 wherein said stop means comprises a ramp and a retainer for facilitating movement of the wheel of said flat panel into said retainer while resisting movement out of said retainer, respectively.

* * * * *